United States Patent [19]

Yasumuro et al.

[11] Patent Number: 4,858,782

[45] Date of Patent: Aug. 22, 1989

[54] METAL VESSEL HAVING CIRCUMFERENTIAL SIDE SEAM AND PROCESS FOR PRODUCTION THEREOF

[75] Inventors: Hisakazu Yasumuro; Michio Watanabe, both of Yokohama; Kazuo Taira, Tokyo; Tsuneo Imatani; Hideo Kurashima, both of Yokosuka, all of Japan

[73] Assignee: Toyo Seikan Kaisha, Ltd., Tokyo, Japan

[21] Appl. No.: 727,186

[22] Filed: Apr. 25, 1985

Related U.S. Application Data

[63] Continuation of Ser. No. 416,378, Sep. 9, 1982, abandoned.

[30] Foreign Application Priority Data

Sep. 17, 1981 [JP] Japan ..... 56-145514

[51] Int. Cl.[4] ..... B65D 8/22; B23P 11/02; B32B 31/06; B32B 31/28

[52] U.S. Cl. ..... 220/458; 29/447; 156/69; 156/275.7; 156/282; 156/294; 220/1 BC; 220/67; 220/80; 220/455; 413/7; 413/22

[58] Field of Search ..... 220/458, 67, 80, 455, 220/81, 1 BC, 75, 454; 229/5.5; 156/69, 308.2, 308.4, 272.4, 275.7, 309.9, 282, 294; 29/447; 413/7, 22

[56] References Cited

U.S. PATENT DOCUMENTS

| | | | |
|---|---|---|---|
| 579,969 | 4/1897 | Fellows | 29/447 X |
| 2,967,161 | 1/1961 | Hart | 220/81 R X |
| 3,424,343 | 1/1969 | Hoeffelman | 229/5.5 X |
| 3,438,116 | 4/1969 | Stengle, Jr. | 29/447 |
| 3,819,085 | 6/1974 | Rohowetz | 220/81 X |
| 3,912,154 | 10/1975 | Godav | 220/67 X |
| 3,928,109 | 12/1975 | Pollock et al. | 156/69 |
| 3,937,641 | 2/1976 | Kushner et al. | 156/294 X |
| 4,033,474 | 7/1977 | Rentmeester | 220/8 TR X |
| 4,054,227 | 10/1977 | Saunders | 220/458 |
| 4,258,855 | 3/1981 | Gordon | 220/67 X |
| 4,293,353 | 10/1981 | Pelton et al. | 220/67 X |
| 4,313,545 | 2/1982 | Maéda | 220/1 BC |
| 4,350,261 | 9/1982 | Roth | 220/67 X |
| 4,372,459 | 2/1983 | Newman | 220/76 |

FOREIGN PATENT DOCUMENTS

| | | | |
|---|---|---|---|
| 906381 | 8/1972 | Canada | 29/447 |

*Primary Examiner*—Allan N. Shoap
*Attorney, Agent, or Firm*—Sherman and Shalloway

[57] ABSTRACT

Disclosed is a metal vessel comprising upper and lower members, each of which consists of a seamless molded metal cup having a protecting resin cover layer, the open end portions of the upper and lower members being lap-bonded to each other through an adhesive to form a circumferential side seam, said metal vessel being characterized in that the open end portion defining the inner side of the circumferential side seam has a layer of a thermoplastic resin adhesive tape heat-bonded along the entire circumference of said end portion while wrapping the end edge and adjoining inner and outer side faces therein, a layer located on the outer side face of the adhesive tape is extended along the lap-bonded portion, and the adhesive layer present in the lap-bonded portion satisfies the following requirement:

$$0.95 \geqq \frac{S1}{t_o \times lo} \geqq 0.05$$

wherein S1 stands for the sectional area ($mm^2$) of the adhesive layer present in the lap-bonded portion, lo stands for the width (mm) of the lap-bonded portion, and $t_o$ stands for the thickness (mm) of the adhesive tape present on the inner side of the inner open end portion.

14 Claims, 5 Drawing Sheets

METAL VESSEL HAVING CIRCUMFERENTIAL SIDE SEAM AND PROCESS FOR PRODUCTION THEREOF

This application is a continuation of application Ser. No. 416,378, filed Sept. 9, 1982, now abandoned.

BACKGROUND OF THE INVENTION

1. Field of the Invention

The present invention relates to a metal vessel having a circumferential side seam formed by lap bonding and a process for the production of this metal vessel. More particularly, the present invention relates to a metal vessel, especially in the form of a bottle, which is highly improved in the adhesion, sealing property and corrosion resistance of the seam, and a process for the production of this metal vessel.

2. Description of the Prior Art

In conventional metal cans, sealing between a can body member and a can lid member is mainly accomplished by double seaming of both the members. More specifically, in case of a can body member having a side seam, for example, that of a three-piece can, top and bottom lids are double-seamed to the can body member, and in case of a can body member having no seam between the can bottom and side wall, which is formed by draw forming or draw-ironing forming, for example, that of a two-piece can, one can lid is double-seamed to the open end portion of the can body member.

However, when sealing of a plurality of members constituting a can is accomplished by double seaming, various defects arise. In the first place, the sealed portion formed by double seaming is poor in pressure resistance and impact resistance. In the second place, the material to be used is limited because double seaming is carried out. In the bonding method utilizing the double-seaming operation, the material constituting the seam is first deformed by pressure or shock applied to the seam, and peeling of the sealant, leakage at the seam or destruction of the seam per se is readily caused. In case of metal cans, it is always required to decrease the cost of the metal material necessary for production of can bodies by reducing the thickness of the side wall portion and decreasing the weight per unit volume. However, if the side wall portion of a can body is reduced, the buckling strength should naturally be reduced. When a can lid is double-seamed to a can body, the axial load to be applied to the can body by a double seamer is 120 to 200 Kg, and if the thickness of the side wall portion is reduced below a certain limit, double-seaming of a can lid becomes difficult.

In view of the foregoing, bonding of a plurality of members constituting a metal vessel through a circumferential side seam is not preferred from the viewpoint of the pressure resistance or impact resistance or in order to reduce the thickness of the material.

SUMMARY OF THE INVENTION

It is therefore a primary object of the present invention to improve the adhesion, sealing property and corrosion resistance in a metal vessel having a circumferential side seam formed by lap bonding.

Another object of the present invention is to provide a process in which a metal vessel excellent in the adhesion, sealing property and corrosion resistance of the seam can be prepared at a high efficiency by relatively simple operations.

In accordance with one aspect of the present invention, there is provided a metal vessel comprising upper and lower members, each of which consists of a seamless molded metal cup having a protecting resin cover layer, the open end portions of the upper and lower members being lap-bonded to each other through an adhesive to form a circumferential side seam, said metal vessel being characterized in that the open end portion defining the inner side of the circumferential side seam has a layer of a thermoplastic resin adhesive tape heat-bonded along the entire circumference of said end portion while wrapping the end edge and adjoining inner and outer side faces therein, a layer located on the outer side face of the adhesive tape is extended along the lap-bonded portion, and the adhesive layer present in the lap-bonded portion satisfies the following requirement:

$$0.95 \geqq \frac{S1}{t_o \times lo} \geqq 0.05$$

wherein S1 stands for the sectional area ($mm^2$) of the adhesive layer present in the lap-bonded portion, lo stands for the width (mm) of the lap-bonded portion, and $t_o$ stands for the thickness (mm) of the adhesive tape present on the inner side of the inner open end portion.

In accordance with another aspect of the present invention, there is provided a process for the production of metal vessels having a circumferential side seam, which comprises lap-bonding open ends lf lower and upper members, each of which consists of a seamless molded metal cup having a protecting resin cover layer, to each other through an adhesive to form a circumferential side seam, said process being characterized by applying a thermoplastic resin adhesive tape to the outer side face of the open end portion of the molded cup to be located on the inner side of the resulting circumferential side seamm in such a manner that a part of the adhesive taper protrudes from said open end portion, bending the protruding portion of the adhesive tape inwardly to wrap around the end edge and adjoining inner face side of said open end portion in the bent protruding portion of the adhesive tape, fusion-bonding the adhesive tape to said open end portion, fitting the other molded cup in the adhesive tape-applied molded cup, fusing the adhesive layer placed under compression between the open end portions of both the molded cups and strongly bonding both the open end portions to each other so that the difference between the outer diameter of the inner open end portion and the inner diameter of the outer open end portion is 0.1 to 1.9 times the thickness of the adhesive tape.

Figure 1:
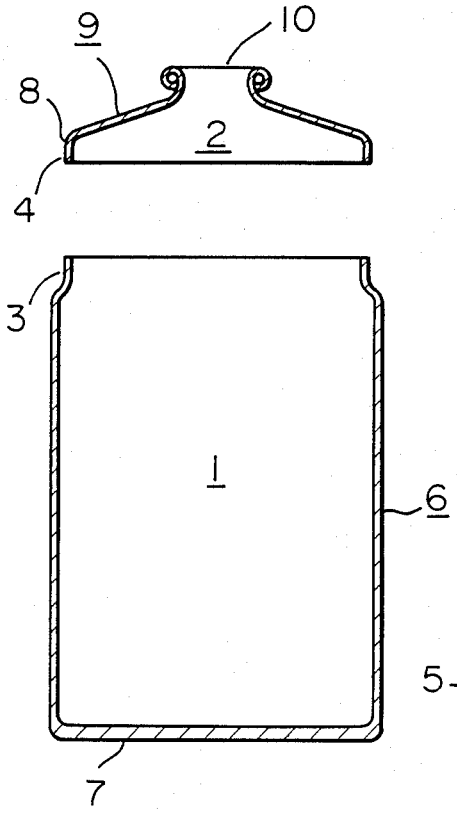
FIG. 1 is a sectional view illustrating independently upper and lower members of the metal vessel of the present invention.

In the drawings, reference numerals 1, 2, 3, 4, 5, 6, 7, 9, 10, 11*a*, 11*b*, 12*a*, 12*b*, 13, 17 and 18 represent a lower member, an upper member, an open end portion, an open end portion, a side seam, a side wall portion, a bottom, a top wall, a pouring mouth, a protecting resin cover layer on the inner face side, a protecting resin cover layer on the inner face side, a protecting resin cover layer on the outer face side, a protecting resin cover layer on the outer face side, an adhesive, an adhesive layer and a lap-bonded portion, respectively.

DETAILED DESCRIPTION OF THE INVENTION

The present invention will now be described in detail with reference to the accompanying drawings.

Figure 2:
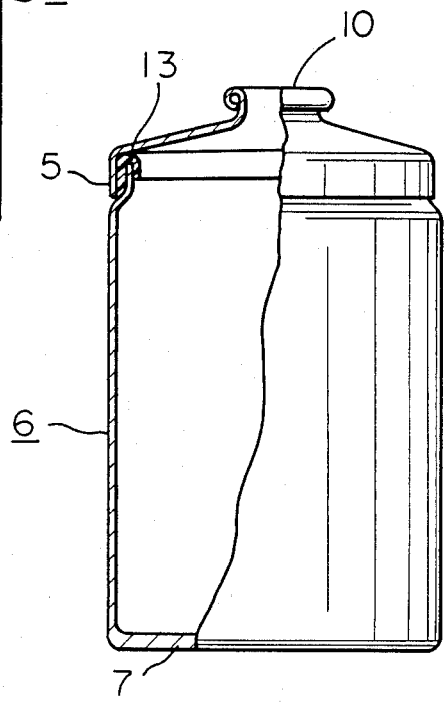
FIG. 2 is a partially sectional view illustrating the metal vessel of the present invention.
Figure 3:
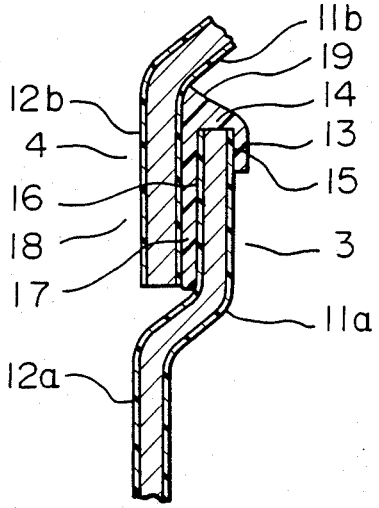
FIGS. 3 and 4 are enlarged sectional views illustrating the lap-bonded portion of upper and lower members.
Figure 4:
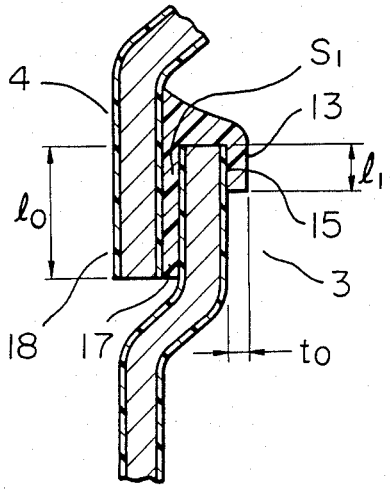

In one preferred embodiment of the present invention, illustrated in FIGS. 1 through 3, a metal vessel comprises a lower member 1 formed of a seamless molded cup of a metal such as a tin-deposited steel plate and an upper member 2 formed of aseamless molded cup of a metal. These molded cups are integrated in the form of a vessel by lap-bonding open end portions 3 and 4 to form a circumferential side seam 5.

These seamless molded cups 1 and 2 are formed by draw forming or draw ironing of a metal material. In the embodiment illustrated in the accompanying drawings, the lower member 1 comprises a tall thin side wall portion 6 formed by deeply draw-ironing a metal material and a thick bottom portion 7 which is not substantially ironed. The upper member 2 comprises a short side wall 8 formed by shallow drawing of a metal material and a top wall 9. The height of the side wall portion 8 of the upper member 2 is equal to or slightly larger than the width of the seam 5. The top wall 9 of the upper member 2 has a convex taper face, and a pouring mouth 10 for charging and discharging the content is formed at the center of the top wall 9. As is apparent from the foregoing description, the upper member 2 is bonded in the form of a shoulder and neck of a so-called bottle to the lower member 1.

In the embodiment shown in FIGS. 1 through 3, the open end portion 3 of the lower member 1 is drawn by necking of the adjoining portion so that the diameter is smaller than that of the other barrel wall portion, and the open end portion 3 is fitted and inserted in an open end portion 4 of the upper member 2 having a larger diameter.

Protecting resin cover layers 11*a* and 11*b* are formed on the inner faces of the lower and upper members 1 and 2, respectively, and protecting resin cover layers 12*a* and 12*b* are formed on the outer surfaces of the lower and upper members 1 and 2, respectively.

In the metal vessel of the present invention, the open end portion 3 of the lower member 1 is lap-bonded to the open end portion 4 of the upper member 2 through an adhesive 13, and as clearly shown in an enlarged sectional view of FIG. 3, this adhesive 13 is composed of a thermoplastic resin adhesive tape. The present invention is characterized in that the tape 13 is heat-bonded while completely wrapping therein the inner end portion to be formed in the inner side of the circumferential side seam 5, namely the cut edge 14 of the open end portion and the adjoining inner and outer side faces 15 and 16, and that the layer located on the outside of the tape 13 is extended along the lap-bonded portion 18 and the adhesive layer 17 present on the lap-bonded portion satisfies the requirement represented by the following formula (1);

$$0.95 \geqq \frac{S1}{t_o \times lo} \geqq 0.05 \qquad (1)$$

wherein S1 stands for the sectional area ($mm^2$) of the adhesive layer present in the lap-bonded portion, lo stands for the width (mm) of the lap-bonded portion, and $t_o$ stands for the thickness (mm) of the adhesive tape present on the inner side of the inner open end portion.

In the case where the open end portions 3 and 4 are lap-bonded through an adhesive, by customary means it is difficult to assuredly protect the end portion located on the inner side of the seam and a problem of dissolution of the metal into the content from this open end portion arises. Furthermore, leakage due to corrosion of this open end portion is caused.

In case of a vessel barrel in which the lap-bonded portion is straight, there may be considered adoption of a method in which a resin film, melted resin extrudate or resin solution is applied to the edge of the material, which is to be located on the inner side after bonding, to protect this side edge. However, in the case where open end portions of two seamless molded cups are lap-bonded, it is substantially impossible industrially to apply a resin to the inner side of the seam. Furthermore, even if a resin is applied to the inner side, it is very difficult to make the resin adhere completely to the exposed end portion.

In contrast, according to the present invention, by heat-bonding a preformed thermoplastic resin adhesive to the open end portion 3 to be formed in the inner side of the seam, inclusive of the cut edge 14 and adjoining inner and outer side faces 15 and 16 of the metal material, prior to fitting of seamless molded cups, the exposed cut edge 14 located on the inner side of the seam can be covered completely. If a thermoplastic resin tape is used, even in a cut edge portion, covering of which is most difficult, the resin cover layer has a uniform thickness inherent to the tape and the cut edge portion is completely covered. Furthermore, this resin tape 13 which is used for covering and protecting the exposed end edge in the above-mentioned manner can also be used as an adhesive for bonding the lap-bonded portion 18 to the layer 17 located on the outer face side of the adhesive tape, whereby the thickness and width necessary for covering and protection and the thickness and width necessary for bonding can always be uniformly obtained stably. Moreover, since this tape is composed of a high-molecular-weight thermoplastic resin material, the strength of the material per se is high and the bonding strength of the seam is high, and a metal vessel having a seam excellent in the creep resistance under heat and pressure and the impact resistance can be obtained.

Another problem encountered in production of vessels having a circumferential side seam is that it is difficult to compress the lap-bonded portion at the bonding step. More specifically, when open end portions of two seamless molded cups are subjected to butt bonding, it is possible to perform bonding while compressing the cups in the axial direction, but when both the open end portions of the molded cups are lap-bonded, even if such compression means is adopted, only a shearing force is imposed on the bonded portion and attainment of strong bonding cannot be expected. Moreover, because of the structure of the vessel, compression of the portion to be formed into a seam in the lapping direction, which is performed in case of ordinary straight lap bonding, is substantially impossible.

In the present invention, the sectional area S1 of the adhesive layer 17 present in the lap-bonded portion 18 is always made smaller than the product ($t_o \times lo$) of the width of the lap-bonded portion 18 and the thickness of the adhesive tape 13, whereby the adhesion strength and sealing property (air tightness) of the seam can highly be improved. In the above formula (1), ($t_0 \times lo$) represents the sectional area of the adhesive tape present in the lapped portion before bonding, and the fact that the value of ($t_o \times lo$) is larger than S1 means that after the adehsive resin has filled the lapped portion at the heat-bonding step, the adhesive resin flows out into portions other than the lapped portion. In fact, as shown in FIG. 3, the protruding portion 19 of the adhesive resin is inevitably present in the seam of the metal vessel according to the present invention. Since the vessel of the present invention has a structure in which the adhesive resin completely fills the lapped portion and protrudes into the outer portion, the adhesion and air tightness of the seam are complete.

It is important that the above-mentioned ratio S1($t_o \times lo$) should be in the range of from 0.05 to 0.95, especially from 0.5 to 0.9. If this value is too large and exceeds the above range, the adhesion or air tightness becomes insufficient, and if the above value is too small and below the above-mentioned lower limit, an especially thin portion is formed in the adhesive layer, and the adhesion of air tightness is reduced.

In order to attain the objects of the present invention, it is preferred that the thickness $t_o$ of the adhesive tape 13 be 0.01 to 0.2 mm, especially 0.02 to 0.1 mm. Similarly, it is preferred that the width lo of the lap-bonded portion 18 be 2 to 30 mm, especially 3 to 10 mm.

In order to protect the cut edge, it is preferred that the width l1 of the portion of the adhesive tape 13 covering the inner side face 15 of the inner open end portion 3 be at least 0.5 mm, especially 1 to 3 mm.

In view of the heat bondability or heat resistance, it is important that the thermoplastic resin tape should have a softening point (melting point) of 100° to 240° C., especially 120° to 240° C., and in view of the flowability within the lap-bonded portion, the wetting property with the material and the adhesion strength, it is preferred that the melt viscosity of the thermoplastic resin adhesive tape be 1000 to 500000 poises at a temperature higher by 30° C. than the softening point (melting point). Moreover, in view of the adaptability to the operation of covering the inner open end portion, it is preferred that the flexural modulus of the thermoplastic resin adhesive tape be relatively low and in the range of from $0.05 \times 10^4$ to $3 \times 10^4$ Kg/cm$^2$ at 20° C.

The adhesive that is used in the present invention is composed of a film-forming thermoplastic resin, and in view of the adhesion to the cut edge of the metal material or the primer, it is preferred that the thermoplastic resin contains polar groups at a certain concentration on the main or side chains thereof. More specifically, in the present invention, it is preferred that a thermoplastic resin containing carbonyl groups $$(-\underset{\underset{O}{\|}}{C}-)$$

derived from a carboxylic acid, an acid anhydride, a carboxylic acid salt, an ester, an amide, a urea compound or a urethane compound at a concentration of 12 to 1400, especially 50 to 1200, milliequivalents (meq) per 100 g of the polymer be used as the main component of thermoplastic resin adhesive. If this thermoplastic resin is used, especially good results can be obtained with respect to bonding and folding of the film and the corrosion resistance of the portion not coated with the primer, such as the end edge.

This thermoplastic polymer is obtained by including a monomer having a functional group as described above into the main polymer chain by homopolymerization or copolymerization or by bonding this monomer to a thermoplastic polymer by graft polymerization or terminal treatment. Furthermore, a carbonyl group-containing thermoplastic resin as mentioned above can be prepared by oxidizing a hydrocarbon polymer such as an olefin resin.

Preferred thermoplastic resins are described below, though the resins that can be used in the present invention are not limited to those exemplified below.

(a) Polyesters comprising recurring units represented by the following general formula:

$$[\!+\!O-R_1\!+\!_n O-\overset{\overset{O}{\|}}{C}-R_2-\overset{\overset{O}{\|}}{C}\!+\!] \quad (2)$$

or $$[\!+\!O-R_1\!+\!_n O-R_2-\overset{\overset{O}{\|}}{C}\!+\!] \quad (3)$$

wherein $\!+\!O-R_1\!+\!_n$ stands for an oxyalkylene group having 2 to 6 carbon atoms or a polymer thereof and $R_2$ stands for an alkylene or arylene group having 2 to 24 carbon atoms. For example, there can be mentioned homopolyesters comprising one dibasic acid component selected from terephthalic acid, isophthalic acid, adipic acid, sebacic acid, maleic acid and fumaric acid and at least one glycol component selected from ethylene glycol, tetramethylene glycol, propylene glycol, diethylene glycol and triethylene glycol, and copolyesters comprising a plurality of monomers as one or both of the dibasic acid and glycol components. More specifically, there can be mentioned polyethylene adipate, polyethylene sebacate, polyethylene terephthalate, polytetramethylene isophthalate, polyethylene terephthalate/isophthalate, polytetramethylene terephthalate, polyethylene/tetramethylene terephthalate and polyethylene hydroxybenzoate. In order to improve properties of a film, some of these polyesters may be blended, or these polyesters may be blended with a polyolefin resin such as polyethylene, polypropylene, an ionomer, an ethylene/vinyl acetate copolymer or modified polypropylene.

(b) Homopolymers or copolymers of monomers represented by the following general formula:

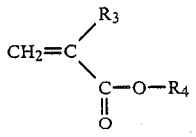

(4)

wherein $R_3$ stands for a hydrogen atom or lower alkyl group and $R_4$ stands for a hydrogen atom or an alkyl group having 1 to 12 carbon atoms, or copolymers or acrylic-modified polyolefins comprising monomers of the above formula (4) and olefins or other vinyl monomers.

For example, there can be mentioned polyacrylic acid esters, polymethacrylic acid esters, ethylene/acrylic acid ester copolymers, acrylic acid ester/acrylic acid copolymers, ethylene/acrylic acid copolymers, styrene/methacrylic acid ester/acrylic acid copolymers, acrylic acid ester/vinyl chloride copolymer, acrylic acid ester-grafted polyethylene, methacrylic acid ester/vinyl chloride copolymers, styrene/mechacrylic acid ester/butadiene copolymers and methacrylic acid-/acrylonitrile copolymers.

(c) Copolymers of vinyl esters represented by the following general formula:

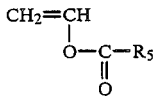

(5)

wherein $R_5$ stands for a hydrogen atom or an alkyl or phenyl group, with olefins or other vinyl monomers or partial saponification products thereof.

For example, there can be mentioned partially saponified ethylene/vinyl acetate copolymers, ethylene/vinyl propionate copolymers, ethylene/vinyl acetate copolymers, acrylic acid ester/vinyl acetate copolymers and vinyl chloride/vinyl acetate copolymers.

(d) Ionomers (ion-crosslinked olefin copolymers) obtained by neutralizing copolymers of olefins with unsaturated carboxylic acids, optionally together with other vinyl monomers, by an alkali metal, an alkaline earth metal or an organic base, for example, Surlyns supplied by Du Pont Co., U.S.A.

(e) Copolymers of maleic anhydride with other vinyl monomers and maleic anhydride-modified polyolefins, such as maleic anhydride/styrene copolymers, maleic anhydride-modified polypropylene and maleic anhydride-modified polyethylene.

(f) Polycarbonates having recurring units represented by the following formula:

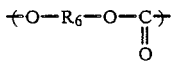

(6)

wherein $R_6$ represents a hydrocarbon group having 8 to 15 carbon atoms, and copolycarbonates with an aliphatic or aromatic dihydroxy compound.

For example, there can be mentioned poly-p-xylene glycol biscarbonate, poly-dihydroxydiphenylmethane carbonate, polydihydroxydiphenylethane carbonate, poly-dihydroxydiphenyl-2,2-propane carbonate and poly-dihydroxydiphenyl-1,1-ethane carbonate.

(g) Polyamides having recurring units represented by the following general formula:

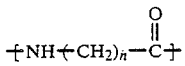

(7)

or

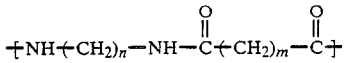

(8)

wherein n is a number of from 3 to 13 and n is a number of from 4 to 11.

For example, there can be mentioned poly-ω-aminocaproic acid, poly-ω-aminoheptanoic acid, poly-ω-aminocaprylic acid, poly-ω-aminopelargonic acid, poly-ω-aminodecanoic acid, poly-ω-aminoundecanoic acid, poly-ω-aminotridecanoic acid, polyhexamethylene adipamide, polyhexamethylene sebacamide, polyhexamethylene dodecamide, polyhexamethylene tridecamide, polydecamethylene adipamide, polydecamethylene sebacamide, polydecamethylene dodecamide, polydecamethylene tridecamide, polydodecamethylene adipamide, polydodecamethylene sebacamide, polydodecamethylene dodecamide, polydodecamethylene tridecamide, polytridecamethylene adipamide, polytridecamethylene sebacamide, polytridecamethylene dodecamide, polytridecamethylene tridecamide, polyhexamethylene azelamide, polydodecamethylene azelamide and polytridecamethylene azelamide.

In order to improve the toughness, handling property and slip characteristic of the film, the above-mentioned copolyamides may be blended with polyolefin resins or the like.

(h) Polyureas consisting of recurring units represented by the following general formula:

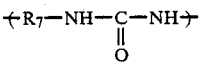

(9)

or

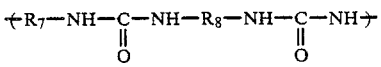

(10)

wherein $R_7$ and $R_8$ stand for an alkylene group having 1 to 13 carbon atoms.

For example, there can be mentioned polyhexamethylene urea, polyheptamethylene urea, polyundecamethylene urea and polynonamethylene urea.

(i) Polyurethanes or polyureaurethanes consisting of recurring units represented by the following general formula:

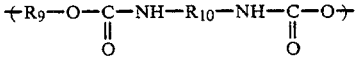

(11)

or

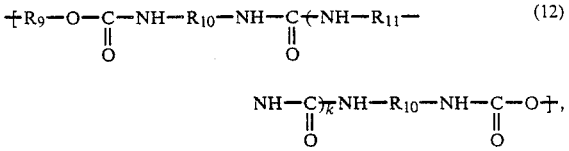

(12)

wherein $R_9$ stands for an alkylene group having 3 to 24 carbon atoms, a polyether residue or a polyester residue, $R_{10}$ stands for an alkylene or arylene group having 3 to 24 carbon atoms, $R_{11}$ stands for an alkylene or arylene group having 1 to 13 carbon atoms, and k is a number of 0 or 1.

For example, there can be mentioned polytetramethylene hexamethylene urethane, polyhexamethylene tetramethylene urethane and polyurethane urea obtained by chain-extending an isocyanate-terminated polyester or polyether.

(j) Films of resins obtained by oxidizing polyethylene, polypropylene or a crystalline ethylene/propylene copolymer with oxygen, ozone or other oxidant.

Resins especially suitable for attaining the objects of the present invention are a polyester, a polyamide, an ionomer, an acid-modified polyolefin and a polycarbonate in order of importance.

These resins should have at least a film-forming molecular weight. If desired, known additives such as ultraviolet absorbers, stabilizers, lubricants, antioxidants, fillers, pigments, dyes and antistatic agents may be incorporated into these resins according to known recipes.

As the metal material constituting the vessel of the present invention, there can be mentioned an untreated steel plate (black plate), various surface-treated steel plates such as deposited steel plates, for example, a tin-deposited steel plate (tinplate), a zinc-deposited steel plate and an aluminum-deposited steel plate, electrolytically treated steel plates, for example, an electrolytically chromic acid-treated steel plate, and chemically treated steel plates, for example, a steel plate treated with phosphoric acid and/or chromic acid, plates of light metals such as aluminum, and composite materials thereof.

The thickness of the seamless molded cup may be changed in the range of a very small thickness obtained by ironing to a large thickness observed when the material is not ironed at all. Ordinarily, however, the side wall portion has a thickness of 0.05 to 0.20 mm, especially 0.06 to 0.17 mm, and the bottom wall or top wall has a thickness of 0.2 to 0.5 mm, especially 0.2 to 0.35 mm.

For formation of the seamless cup, a metal material such as mentioned above is punched into a disc or the like and is subjected to one-stage or multistage drawing between a drawing punch and a drawing die, and if desired, multi-stage ironing is carried out between an ironing punch and an ironing die. Drawing and iron conditions are known, and drawing and ironing can be accomplished very easily according to known procedures.

A protecting varnish may be applied to the surface of the metal material to be subjected to drawing or ironing. Furthermore, a processed cup may be subjected to trimming and, if desired, pickling, for example, a chemical surface treatment with phosphoric acid and/or chromic acid, and the cup may then be coated with a protecting varnish.

As the protecting varnish, there can be used optional paints comprising thermosetting and thermoplastic resins, for example, modified epoxy paints such as phenol-epoxy paints and amino-epoxy paints, vinyl and modified vinyl paints such as vinyl chloride/vinyl acetate copolymer paints, saponified vinyl chloride/vinyl acetate copolymer paints, vinyl chloride/vinyl acetate/maleic anhydride copolymer paints, epoxy-modified epoxyamino-modified vinyl resin paints and epoxy-modified epoxyphenol-modified vinyl resin paints, acrylic resin paints, and synthetic rubber paints such an styrene-butadiene copolymer paints.

These paints are applied in the form of an organic solvent solution such as a lacquer or enamel or an aqueous dispersion or solution by spray coating, dip coating, electrostatic coating or electrophoretic coating. Of course, when a thermosetting resin paint is used, the coating is baked according to need.

Figure 5:
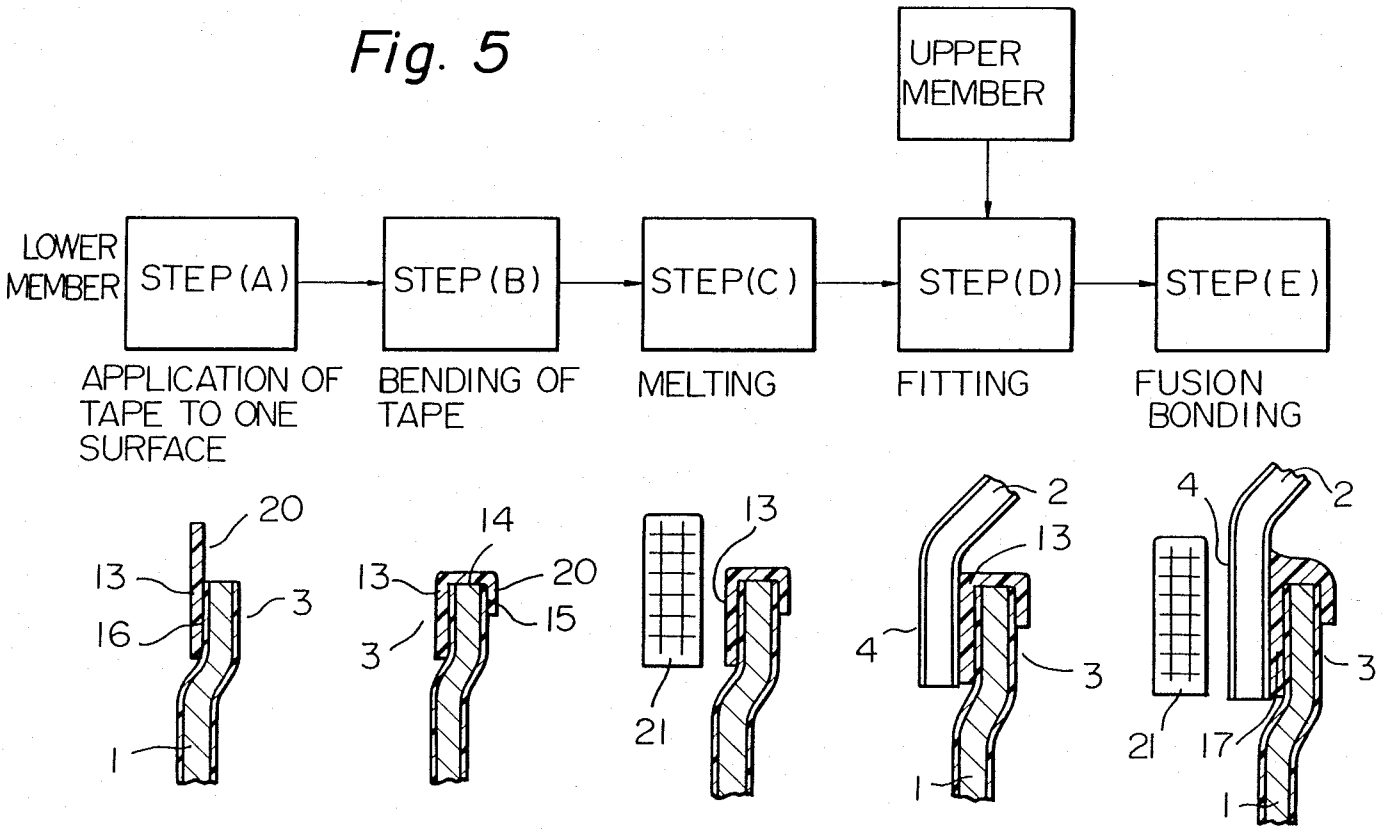
FIG. 5 is a step diagram illustrating the process for the production of the metal vessel of the present invention.

Referring to FIG. 5 illustrating the process for the production of the metal vessel of the present invention, at the step (A), a thermoplastic resin adhesive tape 13 is applied to an outer face 16 of an open end portion 3 of a molded cup 1 to be formed in the inner side of the resulting circumferential side seam so that a part 20 of the tape 13 protrudes over the open end portion 3.

The operation of applying the tape 13 can easily be performed by heating the open end portion 3 of the molded cup 1 by high frequency induction heating, direct fire heating or infrared ray heating and bonding the tape to the heated cup under compression, though the application method is not limited to this method. This heat bonding of the tape may not be complete fusion bonding but may be so-called temporary bonding.

The tape may be supplied in the continuous form or may be bonded to the cup after cutting into a predetermined size. Furthermore, a cut tape may be supplied in the form of a ring.

In the subsequent step (B), the protruding portion 20 of the tape is bent to wrap therein the cut edge 14 of the open end portion 3 and the subsequent inner face 15. Adhesion of the protruding portion 20 of the tape to the cut edge 14 and inner face 15 is performed according to the compression heat bonding method described above with respect to the step (A). Bending of the tape 20 can easily be accomplished by blowing of a gas such as air or contact with a brush. Heating of air to be blown is advantageous.

In the case where bonding of the adhesive tape 13 is insufficient in steps (A) and (B), the open end portion of the cup to which the adhesive tape 13 has been applied is heated at the step (C) by a high frequency induction heating mechanism 21 or the like to complete bonding (fusion bonding).

At the subsequent step (D), the other molded cup 2 is fitted on the molded cup 1 to which the adhesive tape 13 has been applied. Of course, this fitting is performed so that the open end portion 3 of the cup 1 to which the adhesive tape 13 has been applied is located on the inner side of the open end portion 4 of the other cup 2.

Finally in step (E), the adhesive layer 17 compressed between the open end portions 3 and 4 of both the cups 1 and 2 is heated by the high frequency induction heating mechanism 21 or the like to fuse the adhesive layer 17, and forced cooling is then carried out if necessary, whereby a seam is formed. The temperature of heating the adhesive layer is not particularly critical so far as it is higher than the melting point of the adhesive. However, it is ordinarily preferred that the heating temperature be higher by 10° to 80° C. than the melting point.

In the present invention, fusion of the adhesive layer 17 is carried out under such conditions that the difference between the outer diameter $R^1$ of the inner open end portion 3 and the inner diameter $R^2$ of the outer open end portion 4 is 0.1 to 1.9 times, especially 0.5 to 1.6 times, the thickness $t_o$ of the adhesive tape 13. By this fusion, a seam excellent in strength and air tightness can be formed without applying any external compression to the portion to be seamed.

Incidentally, the outer diameter $R^1$ of the inner open portion 3 and the inner diameter $R^2$ of the outer end portion 4 are the values at the fusing step (E), i.e. the diameters after any shrinkage or expansion, respectively, resulting from the fitting step. For example, since the adhesive layer 17 is interposed in the lap portion of the end portions 3 and 4 the size of the end portion 3 is sometimes shrunk in the circumferential direction as compared with the free size, while the size of the end portion 4 is sometimes elongated in the circumferential direction as compared with the free size. The degree of this shrinkage or elongation differs according to the thickness and mechanical properties of the metal material and the melt viscosity of the adhesive resin.

At any rate, in the present invention, if the $(R_2-R_1)/t_o$ ratio is adjusted to 0.1 to 1.9, strong bonding is possible under such conditions that filling and protrusion of the resin can be performed.

Since the sizes of the open end portions of the molded cups 1 and 2 are determined in the above-mentioned ranges, fitting of both the end portions is often difficult. Accordingly, at the fitting step, there is advantageously adopted (i) a method of cooling the open end portion to be located on the inner side to a low temperature, (ii) a method of heating the open end portion to be located on the outer side or (iii) a method comprising the above-mentioned cooling and heating operations (i) and (ii). In the present invention, since the open end portion 3 to be located on the inner side is protected and covered with the resin tape, fitting can be performed easily and the edge of the cup is prevented from being damaged at the fitting step. This is an additional advantage attained by the present invention.

Various modifications may be made to the above-mentioned embodiment in the metal vessel of the present invention.

Figure 6:
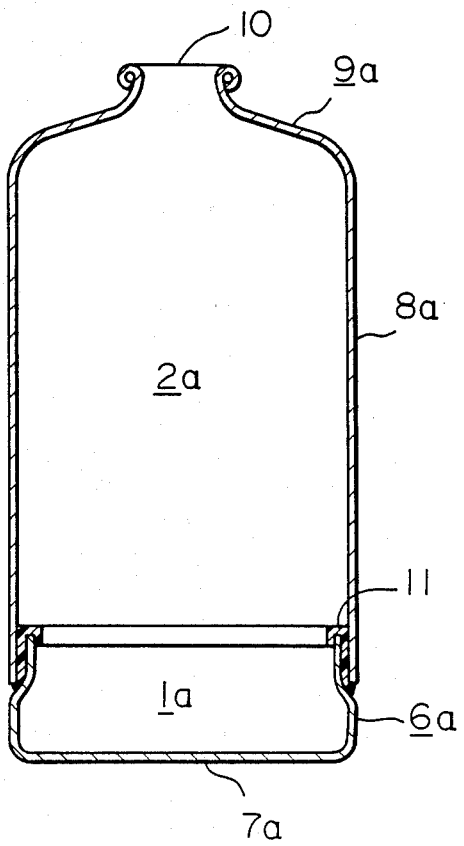
FIG. 6 is a sectional view illustrating an embodiment of the metal vessel of the present invention in which the upper member is deeply draw-ironed.

For example, although the side wall portion of the lower member is highly drawn in the foregoing embodiment, there may be adopted a modification shown in FIG. 6 in which the upper member **2*a* is a draw-ironed cup comprising a tall thin side wall portion 8*a* formed by highly draw-ironing a metal material and a thick top wall 9*a* which is not substantially ironed and the lower member 1*a* is a shallowly drawn cup comprising a short side wall 6*a* formed by shallowly drawing a metal material and a bottom wall 7*a***.

Figure 7:
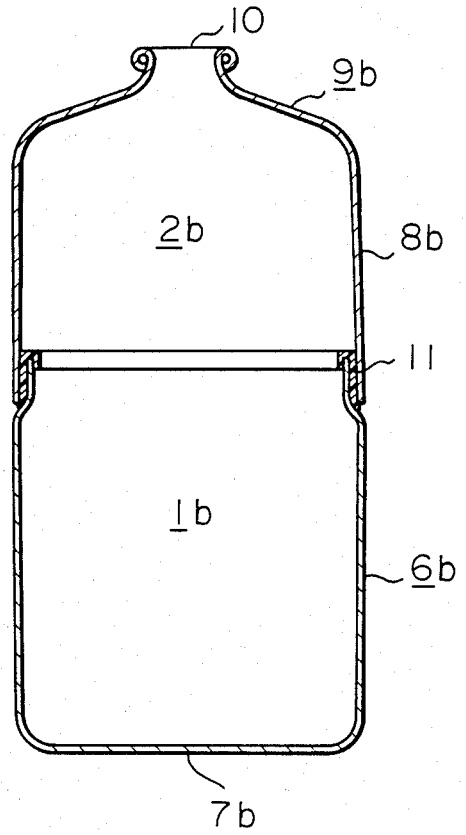
FIG. 7 is a sectional view illustrating an embodiment of the metal vessel of the present invention in which both the upper and lower members are highly draw-ironed.

Furthermore, there may be adopted an embodiment shown in FIG. 7 in which the lower member 1 is a draw-ironed cup as shown in FIGS. 1 through 3, the upper member **2*b* is a draw-ironed cup comprising a tall thin side wall portion 8*b* formed by deeply draw-ironing a metal material and a thick top wall 9*b*** which is not substantially ironed, and the open end portions of both the draw-ironed cups are lap-bonded. According to this embodiment, there is provided a tall metal vessel in which the thickness of the entire side wall portion is reduced by ironing of a high degree.

Figure 8:
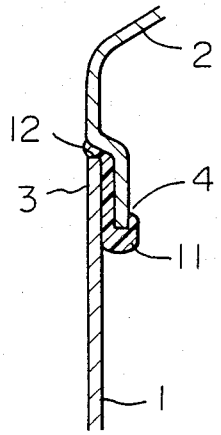
FIG. 8 is an enlarged sectional view illustrating one embodiment of lap bonding of the upper and lower members.

Although the lower open end portion of the upper member is located on the outer side of the seam and the upper open end portion of the lower member is located on the inner side of the seam in the foregoing embodiment, there may be adopted a modification shown in FIG. 8 in which the lower open end portion 4 of the upper member 2 is located on the inner side of the seam and the upper end portion 3 of the lower member 1 is located on the outer side of the seam.

The present invention will now be described in detail with reference to the following Examples.

In these Examples, in the content-filled storage test, evaluations were made on the respective test items described below after 6 months' storage at 37° C. according to the procedures described below. In connection with the dissolution amount of iron, the flavor, the discoloration and the inner face condition, 10 vessels were tested, and 10 vessels were used for each of the other test items.

Dissolution Amount of Iron

The ratio (ppm) of the amount (mg) of iron dissolved in 1000 g of the content was determined.

Flavor

The flavor test was performed by a panel of 10 experts and the flavor was evaluated according to the rating.

5: excellent
4: good
3: fair
2: poor
1: bad

Discoloration

The change of the color of the content was examined.

Inner face condition of vessel

The bonded portion of the inner face of the vessel was visually checked after opening of the vessel to examine the rusting state, the change in the coating and the like.

Deformation strength

An iron weight having a top end radius of 10 mm and a weight of 4 Kg was let to fall down from a height of 10 mm on the bonded portion of the content-filled vessel, and the presence or absence of leakage was checked.

Falling strength

The content-filled vessel was permitted to fall vertically from a height of 90 cm on an iron plate having a thickness of 15 mm with the bottom being located below, and the presence or absence of leakage was checked.

Incidentally, the pressure-resistant strength was evaluated based on the pressure ($Kg/cm^2$) causing peeling in the bonded portion of the vessel when a hydraulic pressure was applied to the interior of the empty vessel.

EXAMPLE 1

A tin-deposited steel plate having a thickness of 0.30 mm was punched into a disc having a diameter of 120 mm, and the disc was formed into a cup having an inner diameter of 85 mm between a drawing punch and a drawing die according to customary procedures.

The cup was subjected to re-drawing and was then ironed by an ironing punch having a diameter of 66.10 mm and an ironing die.

Then, the inner and outer faces of the resulting lower member were degreased and washed, and the lower member was subjected to a customary surface treatment of the phosphoric acid type. The inner and outer faces were coated with an epoxy type paint and the formed coatings were baked, and the lower member was subjected to a necking treatment (the outer diameter of the necked portion was 64.17 mm). A polyester type adhesive tape (having a softening point of 178° C. and a flexural modulus of $1.25\times10^4$ Kg/cm$^2$ at 20° C.) having a thickness of 60 μm and a width of 6 mm was applied to the outer open end portion of the lower member by high frequency induction heating so that the tape protruded over the open end along 2 mm. The protruding portion of the tape was inwardly bent to wrap therein the edge of inner end portion and the subsequent inner face, and the adhesive tape was heated and fusion-bonded to the inner and outer faces of the open end portion.

A tin-deposited steel plate having a thickness of 0.23 mm, to both the faces of which an epoxy type paint had been applied in advance, was punched into a disc having a diameter of 96 mm, and the disc was formed into a lower member according to a customary pressing operation and a pouring mouth was formed on the top wall (the inner diameter of the resulting upper member was 64.20 mm). The open end portions of the adhesive tape-applied lower member and the so-formed lower member were fitted together, and the fitted open end portions were heated at 220° C. by high frequency induction heating to fuse the adhesive and then, the cooling operation was carried out to form a bonded metal vessel. The shape characteristic $Sl/(t_o\times l_o)$ of the adhesive layer present in the lap-bonded portion of the bonded vessel was 0.22. First, the pressure-resistance strength of the bonded portion was examined. Then, cola was cold-filled in the vessel and the pouring mouth was plugged, and heat sterilization was carried out at 42° C. (the spontaneous pressure was 7.0 Kg/cm$^2$) by using a can warmer. In any of the vessels prepared in this Example, peeling or leakage in the circumferential bonded portion was not caused during the above treatment.

The vessels were packed in carton cases (two cases, each case containing 24 vessels therein) and stored at 37° C. for 6 months, and the falling strength, the number of leakage vessels and the deformation strength were examined. The obtained results are shown in Table 1.

From the results shown in Table 1, it will readily be understood that the vessel of the present invention is especially excellent in the strength and sealing property.

EXAMPLE 2

A bonded vessel was prepared in the same manner as described in Example 1 except that the outer diameter of the necked portion of the lower member was changed to 64.14 mm. The shape characteristic $Sl/(t_o\times l_o)$ of the adhesive layer present in the lap-bonded portion of the bonded vessel was 0.51. In the same manner as described in Example 1, the pressure-resistant strength, falling strength, leakage vessel number and deformation strength were examined. The obtained results are shown in Table 1.

From the results shown in Table 1, it will readily be understood that the vessel of the present invention is especially excellent in the strength and sealing property.

EXAMPLE 3

A bonded vessel was prepared in the same manner as described in Example 1 except that the outer diameter of the necked portion of the lower member was changed to 64.11 mm. The shape characteristic $Sl/(t_o\times l_o)$ of the adhesive layer present in the lap-bonded portion of the bonded vessel was 0.79. The pressure-resistant strength, falling strength, leakage vessel number and deformation strength were examined in the same manner as described in Example 1. The obtained results are shown in Table 1.

From the results shown in Table 1, it will readily be understood that the vessel of the present invention is especially excellent in the strength and sealing property.

Comparative Example 1

A bonded vessel was prepared in the same manner as described in Example 1 except that the outer diameter of the necked portion of the lower member was changed to 64.08 mm. The shape characteristic $Sl/(t_o\times l_o)$ of the adhesive layer present in the lap-bonded portion of the bonded vessel was 0.98. The pressure-resistant strength, falling strength, leakage vessel number and deformation strength were examined in the same manner as described in Example 1. The obtained results are shown in Table 1.

From the results shown in Table 1, it will readily be understood that the vessel outside the scope of the present invention is insufficient in strength and sealing property.

TABLE 1

| | Pressure-Resistant Strength (Kg/cm$^2$) | Storage Test Results | | |
|---|---|---|---|---|
| | | Falling Strength | Number of Leakage Vessels | Deformation Strength |
| Example 1 | above 10 | no leakage | 0/10 | no leakage |
| Example 2 | above 10 | no leakage | 0/10 | no leakage |
| Example 3 | above 10 | no leakage | 0/10 | no leakage |
| Comparative Example 1 | 1.5–6 | 5 leakage vessels in 10 tested vessels | 4 leakage vessels in 10 tested vessels | 7 leakage vessels in 10 tested vessels |

EXAMPLE 4

A polyester type adhesive tape (having a softening point of 178° l C. and a flexural modulus of $1.25\times10^4$ Kg/cm$^2$ at 20° C.) having a thickness of 60 μm and a width of 5 mm was applied to the outer open end portion of a lower member prepared in the same manner as described in Example 1 so that the tape protruded along 1.5 mm. Then, a bonded vessel was prepared in the same manner as described in Example 1.

When the shape characteristic of the adhesive tape present in the lap-bonded portion of the bonded vessel was examined, it was found that the width $l_o$ of the lapped portion was 3.8 mm and the length ll of the inner open end portion was 1.4 mm.

Then, the metal vessel was cold-filled with cola, beer or synthetic carbonated drink, and the pouring mouth was plugged. The filled vessel was heat-sterilized under conditions shown in Table 2.

TABLE 2

| Filled Content | Device | Temperature (°C.) | Spontaneous Pressure (Kg/cm$^2$) |
|---|---|---|---|
| Cola | can warmer | 42 | 7.0 |
| Beer | pasteurizer | 63 | 6.1 |
| Synthetic carbonated drink | can warmer | 41 | 7.9 |

These filled vessels were packed in carbon cases (one case for each content) and stored at 37° C. for 6 months, and the dissolution amount of iron, the flavor, the discoloration, the inner face condition of the vessel and the deformation strength were examined. The obtained results are shown in Table 3.

From the results shown in Table 3, it will readily be understood that the vessel of the present invention is especially excellent in the resistance to the corrosive action of the content and the sealing property.

Comparative Example 2

The outer open end portion of a lower member prepared in the same manner as described in Example 1 was covered with the same adhesive as used in Example 1 so that the adhesive tape protruded along 0.3 mm, and a bonded vessel was prepared in the same manner as described in Example 1. The shape characteristic of the adhesive present in the lapped portion of the bonded vessel was such that the width $l_o$ was 5.0 mm and the length ll was 0.2 mm. Then, in the same manner as described in Example 4, the vessel was filled with cola, beer or synthetic carbonated drink, sterilized and stored at 37° C. for 6 months, and the dissolution amount of iron, the flavor, the discoloration, the inner face condition of the vessel and the deformation strength were examined. The obtained results were shown in Table 3.

From the results shown in Table 3, it will readily be understood that if the length ll of the adhesive tape present on the inner side of the inner open end portion is too short, since folding of the adhesive tape is not complete and the cut edge is partially exposed, the resistance to the corrosive action of the content is insufficient.

Comparative Example 3

A polyester type adhesive tape (having a softening point of 178° C. and a flexural modulus of $1.25\times10^4$ Kg/cm$^2$ at 20° C.) was applied to the outer end portion of a lower member prepared in the same manner as described in Example 1 so that the adhesive tape protruded along 3 mm, and a bonded vessel was prepared in the same manner as described in Example 1. The shape characteristic of the adhesive present in the lapped portion of the bonded vessel was such that the width $l_o$ was 1.2 mm and the width ll was 2.7 mm. In the same manner as described in Example 4, the bonded vessel was filled with cola, beer or synthetic carbonated drink, sterilized and stored at 37° C. for 6 months, and the dissolution amount of iron, the flavor, the discoloration, the inner face condition of the vessel and the deformation strength were examined. The obtained results are shown in Table 3.

From the results shown in Table 3, it will readily be understood that if the width $l_o$ of the lapped portion is extremely small, the strength of the vessel is insufficient and the resistance to the corrosive action of the content is low.

TABLE 3

| | Content | Storage Test Results: Dissolution Amount (ppm) of Iron | Flavor | Discoloration | Inner Face Condition | Deformation Strength |
|---|---|---|---|---|---|---|
| Example 4 | cola | 0.33 | 5 | not observed | no change | no leakage |
| | beer | 0.10 | 5 | not observed | no change | no leakage |
| | synthetic carbonated drink | 0.19 | 5 | not observed | no change | no leakage |
| Comparative Example 2 | cola | 13.0 | 2 | not observed | pitting | one leakage vessel in 10 vessels |
| | beer | 6.5 | 2 | slightly opaque | pitting | no leakage |
| | synthetic carbonated drink | 9.4 | 3 | not observed | pitting | no leakage |
| Comparative Example 3 | cola | 6.5 | 3 | not observed | pitting | 7 leakage vessels in 10 vessels |
| | beer | 1.3 | 3 | not observed | no change | 6 leakage vessels in 10 vessels |
| | synthetic carbonated drink | 2.8 | 4 | not observed | no change | 9 leakage vessels in 10 vessels |

EXAMPLE 5

A bonded vessel was prepared in the same manner as described in Example 1 except that a polyester type adhesive tape (having a softening point 180° C. and a flexural modulus of $1.02\times10^4$ Kg/cm$^2$ at 20° C.) having a thickness of 80 μm and a width of 6 mm was used, and the vessel was filled with cola, sterilized and stored at 37° C. for 6 months. The dissolution amount of iron, the flavor, the discoloration and the inner face condition of the vessel were examined. The obtained results are shown in Table 4.

From the results shown in Table 4, it will readily be understood that the vessel of the present invention is especially excellent in the resistance to the corrosive action of the content.

Comparative Example 4

A bonded vessel was prepared in the same manner as described in Example 1 except that a nylon 6/6 adhesive tape (having a softening point of 220° C. and a flexural modulus of $3.2\times10^4$ Kg/cm$^2$ at 20° C.) having a thickness of 50 μm and a width of 6 mm was used. When this adhesive tape was used, folding of the tape was incomplete and the end edge was partially exposed or the tape per se was cracked. Then, in the same manner as described in Example 5, the vessel was filled with cola, sterilized and stored at 37° C. for 6 months, and the dissolution amount of iron, the flavor, the discoloration and the inner condition of the vessel were examined. The obtained results are shown in Table 4.

Comparative Example 5

A bonded vessel was prepared in the same manner as described in Example 1 except that an ethylene/vinyl acetate copolymer adhesive tape (having a softening point of 65° C. and a flexural modulus of $0.01\times10^4$ Kg/cm$^2$ at 20° C.) having a thickness of 120 μm and a width of 6 mm was used. In the case where this adhesive tape was used, when the tape was folded, air was wrapped in the form of a bag in the tape and covering of the edge was incomplete. In the same manner as described in Example 5, the vessel was filled with cola, sterilized and stored at 37° C. for 6 months, and the dissolution amount of iron, the flavor, the discoloration and the inner face condition of the vessel were examined. The obtained results are shown in Table 4.

TABLE 4

| | Storage Test Results | | | |
|---|---|---|---|---|
| | Dissolution Amount (ppm) of Iron | Flavor | Discoloration | Inner Face Condition |
| Example 5 | 0.26 | 5 | not observed | no change |
| Comparative Example 4 | 7.6 | 3 | not observed | pitting |
| Comparative Example 5 | 4.8 | 3 | not observed | no change |

What is claimed is:

1. In a metal vessel having upper and lower members, each of which is in the form of a seamless molded metal cup having a protective resin cover layer over each of the inner and outer facing surfaces thereof with exposed metal end edges, the upper member having a pouring mouth, the upper and lower members having straight end portions fitted in a telescopic relation, the end portions of the upper and lower members being lap-bonded to each other through a thermoplastic resin adhesive forming a circumferential side seam, including inner and outer circumferential laps, the improvement comprising:

a layer of a thermoplastic layer adhesive tape in the lap-bonded circumferential seam filling the space between and adjoining in heat-bonded relation the inner and outer laps, fully wrapping therein the exposed metal end edge of the inner lap, and uniformly covering, along the entire circumference thereof, a portion of the inner face of the inner lap, said adhesive layer in the lap-bonded seam being compressed between the inner and outer circumferential laps to such an extent that a portion of the adhesive resin filling the space between the inner and outer laps is forced to flow out of the lap portion to form a protruded portion of adhesive resin and such that the adhesive layer present in the lap-bonded seam satisfies the following requirement:

$$0.95 \geqq \frac{Sl}{t_o \times lo} \geqq 0.05$$

wherein Sl stands for the sectional area (mm$^2$) of the adhesive layer present in the lap-bonded portion, $l_o$ stands for the width (mm) of the lap-bonded portion, and $t_o$ stands for the thickness (mm) of the adhesive tape present on the inner side of the inner open end portion.

2. A metal vessel as set forth in claim 1, wherein the thickness $t_o$ of the adhesive tape is 0.01 to 0.2 mm.

3. A metal vessel as set forth in claim 1, wherein the width $l_o$ of the lap-bonded portion is 2 is 30 mm.

4. A metal vessel as set forth in claim 1, wherein the portion of the adhesive tape, which covers the inner side of the inner open end portion, has a width of at least 0.5 mm.

5. A metal vessel as set forth in claim 1, wherein the thermoplastic resin has a flexural modulus of $0.05\times10^4$ to $3\times10^4$ kg/cm$^2$ at 20° C.

6. A metal vessel as set forth in claim 1, wherein the ratio $Sl/(t_o\times l_o)$ is in the range of from 0.5 to 0.9.

7. A metal vessel as set forth in claim 6, wherein the thickness $t_o$ is from 0.02 to 0.1 mm and the width $l_o$ is from 3 to 10 mm.

8. A metal vessel as set forth in claim 7, wherein the adhesive tape covering the portion of the inner face of the inner lap has a width of from 1 to 3 mm.

9. A metal vessel as set forth in claim 1, wherein the thermoplastic resin has a softening point in the range of from 120° to 240° C., a melt viscosity of from 1000 to 500,000 poises at a temperature higher by 30° C. than the softening point, and a flexural modulus of $0.05\times10^4$ to $3\times10^4$ kg/cm$^2$ at 20° C.

10. In a process for the production of metal vessels having a circumferential side seam by lap-bonding to each other the open ends of lower and upper protective resin covered seamless molded metal cup members through an adhesive to form a circumferential side seam, the improvement comprising applying a thermoplastic resin adhesive tape to the outer side face of the open end portion of the molded cup to be located on the inner side of the resulting circumferential side seam such that a part of the adhesive tape protrudes from said open end portion, bending the protruding portion of the adhesive tape inwardly to wrap the end edge and adjoining inner face of said open end portion in the bent protruding portion of the adhesive tape, fusion-bonding the bent adhesive tape to said open end portion, telescopically fitting the other molded cup over the fusion-bonded adhesive tape-applied molded cup, thereby placing the fusion-bonded adhesive layer between the open end portions of both the molded cups under compression, and fusing the compressed adhesive layer so as to bond both the open end portions to each other and so that the difference between the outer diameter of the inner open end portion and the inner diameter of the outer open end portion is 0.1 to 1.9 times the thickness of the adhesive tape, and a portion of the adhesive resin between the open end portions forming the circumferential side seam is forced to flow out from between the open end portions to form a protruded portion of adhesive resin thereby further increasing the strength and barrier properties of the circumferential side seam.

11. A process for the production of metal vessels according to claim 10, wherein the adhesive layer is fused by subjecting the open end portions of the fitted molded cups to high frequency induction heating.

12. A process for the production of metal vessels according to claim 10, wherein the thermoplastic resin adhesive tape is applied to the outer side face of the open end portion of the molded cup so that the length of tape protruding from the open end portion is such that when the adhesive tape is bent inwardly to wrap the end edge and adjoining inner face side of the open end portion, the width of the adhesive tape covering the inner face side is at least 0.5 mm.

13. A process for the production of metal vessels according to claim 10, wherein the difference between the outer diameter of the inner open end portion and the inner diameter of the outer open end portion is 0.5 to 1.6 times the thickness of the adhesive tape.

14. A process for forming a metal vessel according to claim 13, wherein the step of telescopically fitting the other molded cup over the adhesive tape-applied molded cup is facilitated either by cooling the open end portion to be located on the inner side to a low temperature, or by heating the open end portion to be located on the outer side or by both cooling the open end portion to be located on the inner side to a low temperature and heating the open end portion to be located on the outer side, thereby facilitating said fitting step.

* * * * *